US006532873B2

(12) United States Patent
Hunold et al.

(10) Patent No.: US 6,532,873 B2
(45) Date of Patent: Mar. 18, 2003

(54) METHOD AND APPARATUS FOR SETTING REGISTRATION IN A PRINTING MACHINE

(75) Inventors: Heiko Hunold, Wattenbek (DE); Ralph Petersen, Kiel (DE); Patrick Metzler, Gettorf (DE)

(73) Assignee: NexPress Solutions LLC, Rochester, NY (US)

( * ) Notice: Subject to any disclaimer, the term of this patent is extended or adjusted under 35 U.S.C. 154(b) by 25 days.

(21) Appl. No.: 09/858,208

(22) Filed: May 15, 2001

(65) Prior Publication Data

US 2001/0042480 A1 Nov. 22, 2001

Related U.S. Application Data

(60) Provisional application No. 60/204,674, filed on May 17, 2000.

(51) Int. Cl.[7] ..... B41F 1/54; B41F 1/66

(52) U.S. Cl. ..... 101/484

(58) Field of Search ..... 347/116; 399/301, 399/66; 101/484, 485, 486, 143, 232, 483

(56) References Cited

U.S. PATENT DOCUMENTS 5,281,981 A * 1/1994 Kajita ..... 347/116
6,052,552 A * 4/2000 Ohsumi et al. ..... 399/394

* cited by examiner

*Primary Examiner*—John Barlow
*Assistant Examiner*—Michael S Brooke
(74) *Attorney, Agent, or Firm*—Lawrence P. Kessler

(57) ABSTRACT

Setting registration, with detection of the entry of a printing substrate (2) into a printing machine (1) and calculation of the beginning of digital production of color separations (3, 3', 3", 3'") to achieve an in-register position of the color separation prints (4, 4', 4", 4'") on a printing substrate (2). This is achieved by the printing substrate (2) being detected before it enters the printing machine (1) and, following this detection, the relative positions of the color separations (3, 3', 3", 3'") being calculated, and by precise detection of the leading edge (5) of the printing substrate (2) being performed as it enters the printing machine (1) and being made the basis for determining the starts of the production of the color separations (3, 3', 3", 3'"), their relative position having been precalculated.

10 Claims, 2 Drawing Sheets

METHOD AND APPARATUS FOR SETTING REGISTRATION IN A PRINTING MACHINE

CLAIM TO PRIORITY

This application claims benefit of U.S. provisional application No. 60/204,674, filed May 17, 2000.

FIELD OF THE INVENTION

The invention relates to a method of, and apparatus for, setting registration, with detection of the entry of a printing substrate into a printing machine having a number of color printing units, and calculation of the beginning of digital production of color separations to achieve an in-register position of the color separation prints on a printing substrate.

BACKGROUND OF THE INVENTION

Printing colored illustrations, in particular color images, is carried out by a number of color separations being printed over one another. These are generally the colors yellow, magenta and cyan as well as black. If required, special colors are added. By overprinting these colors, all color combinations can be achieved, the quality of the prints depending significantly on the in-register overprinting of the color separations. In the case of digital printing processes, for example electrostatic printing processes, the maintenance of the register of the overprint is achieved by the image production devices being controlled in such a way that the color separations meet one another in-register when they are transferred to a printing substrate. This has to be set and, if necessary, readjusted during printing. Since the color separations are produced anew for each individual printed image, a setting or correction after each printing operation is possible.

U.S. Pat. No. 5,678,128 discloses a method and apparatus of the type mentioned at the beginning in which a sensor for detecting the entry of a printing substrate is arranged, and control is provided for the start of printing in the printing units in order to achieve maintenance of register. Since the sensor for detecting the printing substrates is located within the machine, there remains only a very short time in which to be able to perform the calculation before the first color separation has to be produced in order to be transferred to the printing substrate. On the one hand, this requires a high computer capacity and, on the other hand. it limits the speed of the printing operation. If coincidence of register is to be achieved, not only with respect to the image starts but also with respect to a number of or many defined areas on the color separations, then the necessary computer processing requirement is increased considerably. However, this is not possible in the short time available. Therefore, in the prior art, the possibilities of achieving high maintenance of register of the color separations are also limited.

SUMMARY OF THE INVENTION

The invention is therefore based on the object of developing a method and apparatus such that more time is available for calculating the setting values for the registration setting.

With respect to the method according to the invention, the object is achieved by the printing substrate being detected before it enters the printing machine, and, following this detection, the relative positions of the color separations being calculated, and precise detection of the leading edge of the printing substrate being performed as it enters the printing machine and made the basis for determining the starts of the production of the color separations, their relative positions having been precalculated.

With respect to the apparatus, the object is achieved in that a sensor arranged upstream of the printing machine detects the printing substrate before it enters the printing machine and gives a signal to the computer, whereupon the latter calculates the relative positions of the color separations, and in that the sensor arranged in the printing machine gives a signal to devices for determining the release of start signals for the production of the color separations, whose relative positions have been precalculated.

By the invention, therefore, the relatively high processing requirement on computing has been dealt with before a printing substrate enters the printing machine, and the values determined are kept ready in such a way that the allocation of the leading edge of the printing substrate which has entered the printing machine to the precalculated relative positions is all that is required. The allocation is carried out by releasing start signals for the production of the color separations in accordance with precalculated data. This is associated with a low processing requirement on computing, which can be managed in a short time. In this way, in spite of the high computing processing requirement as viewed overall, precise and rapid allocation of the printing substrate to the calculated values is possible. This makes it possible for the invention to achieve an accurate relative position of the color separations. By the invention, a higher print quality can thus be achieved, and the calculation of the register setting is no longer a bottleneck to increasing the printing speed.

The abovementioned advantages of the invention already show an effect if only a calculation of the relative position of the image starts of the color separations is carried out. However, the prolongation of the computing time according to the invention is particularly advantageous when the calculation of the relative positions of the color separations comprises both the image starts and the position of defined areas into which the color separations are subdivided. Here, these regions can be lines of image points in the color separations, or a defined number of lines of image points.

One refinement of the invention provides for the production of the electrostatic latent color separations in order to achieve coincidence of register to be calculated and made the basis for open-loop or closed-loop control. Another, particularly advantageous refinement provides for the positions of the production of the color separations to be coordinated in relation to their points of transfer to the printing substrate in order to achieve coincidence of register, and with the paths of the printing substrate and up to the points of transfer. The second embodiment has the advantage that errors which result from the time/position assignment, for example from a time/distance or a time/angle assignment, are not included in the calculation. In this way, more exact open-loop or closed-loop control is achieved, and therefore a higher maintenance of register and better printing quality.

The apparatus can be developed further in such a way that it is capable of implementing all the aforementioned method features. In this regard, the following refinements of the apparatus are advantageous:

Provision is expediently made for the computer to be loaded with data for the relative position of the carrier elements for the color separations and a substrate carrier and performs a calculation which, with respect to the relative positions of the color separations, gives the image starts and the position of the defined areas into which the color separations are subdivided, and controls the equipment for the production of the color separations on this basis. The data for the relative position of the carrier elements and a substrate carrier can be obtained in various ways. These may be distance/time data relating to the elements which carry images or substrates, or it is possible to provide position data which relate to these elements and are assigned to one another. It is also possible to input calibration tables with appropriate values from experience, which can be assigned to various positions of elements carrying images or substrates. Most expedient is a calibration table which is assigned to the carrier element with a surface for the production of the color separations, which is generally an image cylinder. For such an assignment, the angular positions of these elements can be used. The aforementioned data can also be determined by printing and detecting register marks.

For the last-mentioned purpose, it is proposed that the apparatus have at least one sensor for detecting a component of a color separation, and the computer is such that it coordinates the relative positions, detected in this way, of the individual color separations with one another in order to achieve coincidence of register and coordinates the relative position of the substrate carrier in order to position the print on the latter. Such defined components of a color separation may be the register marks but it is also possible to use other defined components, such as the limits of a picture.

An advantageous development of the apparatus provides for sensors for detecting angular positions of the elements that transfer color separations and the angular positions of the drive roller of the substrate carrier, the computer being such that it coordinates the angular positions of the elements that transfer color separations with one another in order to achieve coincidence of register, and coordinates the angular positions of the drive roller of the substrate carrier with the aforementioned angular positions. The aforementioned sensors can also be sensors for detecting paths, for example of register marks, or they may also be sensors which detect traveling times of elements carrying images or substrates. It is therefore possible for sensors for detecting the paths of the surfaces of the carrier elements, that is to say for example of the image cylinders, to be provided, and sensors can also be provided for detecting the paths of the surfaces of image transfer elements, for example of transfer cylinders. A sensor for detecting the path of the substrate carrier is also possible for the assignment of the printing substrates to the color separations. However, angular position transmitters are preferably provided as the sensors, and a calibration is carried out for the corresponding angular positions.

BRIEF DESCRIPTION OF THE DRAWINGS

The invention will be explained below using an exemplary embodiment illustrated in the drawing, in which.

DETAILED DESCRIPTION OF THE INVENTION

Figure 1:
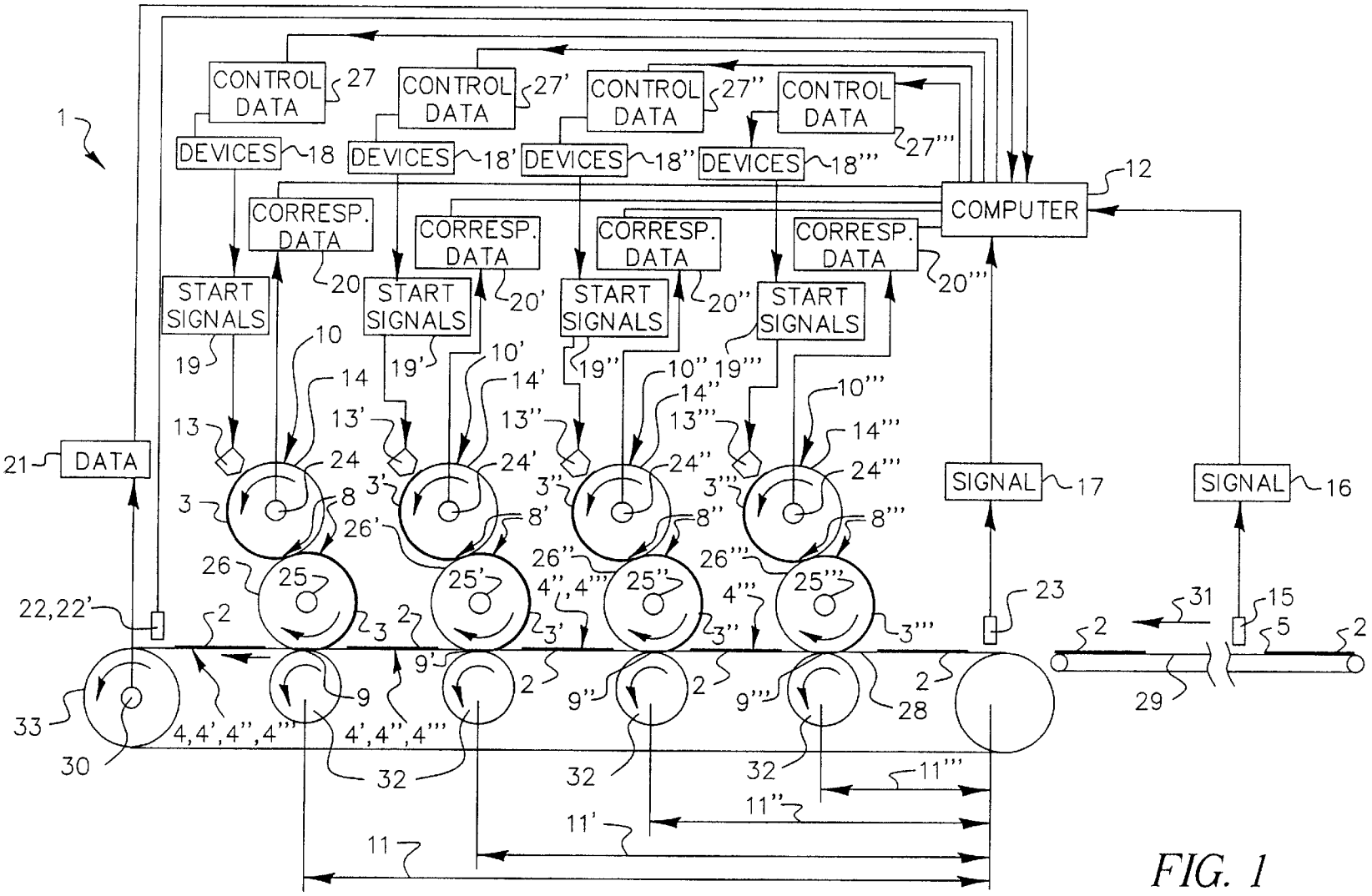
FIG. 1 shows a printing machine with apparatus of the type according to the invention.

FIG. 1 shows a printing machine 1 with apparatus of the type according to the invention. Printing substrates 2 are fed to the printing machine 1 by a belt 29 and then led through the machine by a substrate carrier 28, the printing substrates 2 passing four color printing units 10, 10', 10", 10'". The color printing units 10, 10', 10",10'" have equipment 13, 13', 13", 13'" for producing digital color separations 3, 3', 3", 3'", which are produced on surfaces of carrier elements 14, 14', 14", 14'". These carrier elements 14, 14', 14", 14'" are image cylinders. Of course, such color separations 3, 3', 3", 3'" can also be produced on belts or one after another on a single image cylinder. In the exemplary embodiment illustrated, the color separations 3, 3', 3", 3'" are transmitted to image transfer cylinders 26, 26' 26", 26'" and from there are transferred to the printing substrates 2 at transfer points 9, 9', 9", 9'". The color separations 3, 3', 3", 3'" trace the paths 8, 8', 8", 8'" from their production until their transfer, these paths being shown as thick lines in FIG. 1. These paths 8, 8', 8", 8'" are expediently registered as angular positions 8, 8', 8", 8'", by the sensors 24, 24', 24", 24'" being angular position transmitters. The positions of the substrate carrier 28 are expediently detected as angular positions of the drive roller 33, by the sensor 30 being an angular position transmitter. The color separations 3, 3', 3", 3'" are produced anew for each color separation print 4, 4', 4", 4'". This production takes place before the respective printing substrate 2 arrives at the respective color printing unit 10, 10', 10", 10'".

In order to achieve in-register prints of high quality, the color separation prints 4, 4', 4", 4'" must be printed exactly on one another. For this purpose, it is already known from the prior art to provide a sensor 23 which detects the entry of the printing substrates 2 into the printing machine 1. This sensor 23 registers the arrival of the leading edge 5 of a printing substrate 2 and gives a signal 17 to the computer 12. According to the prior art, it is known for such a computer 12 to calculate the times of the color separations 3, 3', 3", 3'" from their production up to the transfer 9, 9', 9", 9'" to the printing substrates 2, and the times which the printing 2 need from their detection by the sensor 23 up to the transfer points 9, 9', 9", 9'", and to control the production of the color separations 3, 3', 3", 3'" in such a way that the image starts 6 coincide.

The exemplary embodiment illustrated corresponds to a development of the invention, which provides for the computer 12 to assign the positions 8, 8', 8", 8'"—that is to say the angles or paths of the color separations 3, 3', 3", 3'"—to one another in terms of their relative position, and then to coordinate these positions 8, 8', 8", 8'" with the positions 11, 11', 11", 11'" of the printing substrate 2 in such a way that the image starts 6 come to lie at the correct point on the printing substrate 2.

The problem with machines from the prior art was that these calculation operations have to be completed before the printing substrate 2 reaches the first transfer point 9'". Given the current high-speed running of printing machines, the available time is too short, which means that there is a bottleneck here to increasing the speed, or that the computation operations have to be highly simplified. Both are undesirable, particularly since the requirement for a higher print quality also necessitates significantly more comprehensive calculations. This is explained using the illustration of FIG. 2.

Figure 2:
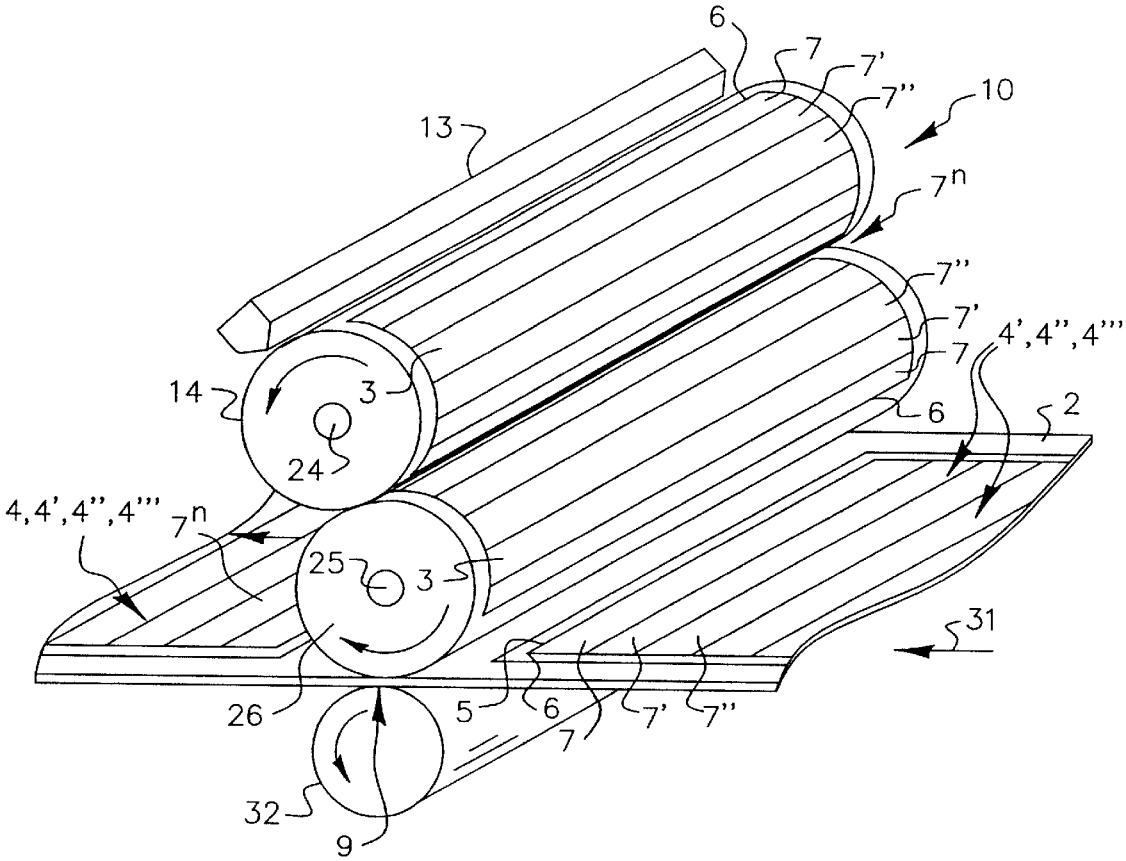
FIG. 2 shows a color printing unit of the printing machine in a perspective view.

FIG. 2 shows a color printing unit 10 of the printing machine 1 in a perspective view. This color printing unit 10 is used to illustrate how the color separation 3 is subdivided into defined areas 7, 7', 7", . . . , $7^n$, in order to calculate the positions 8 and 11 for each of these defined areas 7, 7', 7", . . . , $7^n$. Accordingly, these positions 8, 8', 8", 8'" and the positions 11, 11', 11", 11'"—at which, when they are reached by the printing substrate 2, the production of the color separations 3, 3', 3", 3'" must begin—are calculated for all the color printing units 10, 10', 10", 10'", in order to make them coincide for all the defined areas 7, 7', 7", . . . , $7^n$.

However, such an outlay on computing can as a rule no longer be managed following the detection at the sensor 23 of the entry of a printing substrate 2 into the printing machine.

For this reason, the invention provides for a sensor 15 to be arranged upstream of the printing machine 1 and for this sensor 15 to be arranged, for example, on the belt 29 for feeding printing substrates 2 to the printing machine 1. This sensor 15 detects the leading edge 5 of a printing substrate 2 and gives a signal 16 to the computer 12, in order that the latter begins the calculation of the positions 8, 8', 8", 8'" and assigns these to one another in-register. At the same time, it is also possible for the computer 12 to calculate the positions 11, 11', 11", 11'" of the printing substrate 2 on the substrate carrier 28 already, and to assign these positions 11, 11', 11", 11'" in an appropriate way to the positions 8, 8', 8", 8'", in order that all the image starts 6 of the color separation prints 4, 4', 4", 4'" come to lie at the correct points on the printing substrates 2. Furthermore, the computer 12 also performs these calculations for the defined areas 7, 7', 7", . . . , $7^n$ of the color separations 3, 3', 3", 3'". Instead of the aforementioned positions 8, 8', 8", 8'", 11, 11', 11", 11'", the corresponding positions 8, 8', 8", 8'", 11, 11', 11", 11'"of the surfaces of the elements 14, 14', 14", 14'", 26, 26', 26", 26'" that transfer the color separations can be coordinated with one another, and these can be coordinated with the paths 11, 11', 11", 11'" of the surface of the substrate carrier 28.

If the printing substrate 2 carried on the belt 29 then reaches the printing machine 1, that is to say on the substrate carrier 28, and is detected by the sensor 23, the computer 12, after receiving the signal 17, has to assign these calculations only to that leading edge 5 of the printing substrate 2 which has just been detected at that moment.

The computer 12 also provides the control data 27, 27', 27", 27'" for the in-register assignment of the color separations 3, 3', 3", 3'" and the assignment of the latter to the printing substrate 2. In order to release this data 27, 27', 27", 27'", devices 18, 18', 18", 18'" are provided which, in accordance with the time or preferably in accordance with the position of the printing substrate 2 on the substrate carrier 28, determine the release of said data. Then, on the basis of start signals 19, 19', 19", 19'", the data 27, 27', 27", 27'" is released for the image starts 6 and for the defined areas 7, 7', 7", . . . , $7_n$, and the color separations 3, 3', 3", 3'" are set up.

In order to be able to assign the positions 11, 11', 11"11'" of the substrate carrier 28 or of a printing substrate 2 lying on it to the positions 8, 8', 8", 8'" of the color separations 3, 3', 3", 3'", and also to be able to assign the latter mutually, it is necessary for positions of the substrate carrier 28 and of the image cylinders 14, 14', 14", 14'" to be detected. It is also expedient for the positions of the image transfer cylinders 26, 26', 26", 26'" to be detected. The detection of the positions 11, 11', 11", 11'" of the substrate carrier 28 is carried out by a sensor 30 already mentioned, which transmits the data 21 to the computer 12. In addition, the sensors 24, 24', 24", 24'" are provided for detecting the positions of the image cylinders 14, 14', 14", 14'" and likewise give the corresponding data 20, 20', 20'" to the computer 12. Sensors 25, 25', 25", 25'" are also provided for the image transfer cylinders 26, 26', 26", 26'" and likewise transmit their data to the computer 12, these data lines not having been drawn in for clarity. These sensors 30, 24, 24', 24", 24'", 25, 25', 25", 25'", in addition to being angular position transmitters, can also be sensors which detect distance markings on the surfaces.

Positions can also be detected by registration marks; for this purpose, a sensor 22 is provided which determines the positions of printed registration marks. It may be a sensor 22', which detects the position relationships of the register marks directly, and gives this data to the computer 12. The detection of registration marks in this way can also be designed as the detection of distance or time. It can also be used to monitor the aforementioned calculations or to correct these by a control system. The correction can be made each time a color separation 3, 3', 3", 3'" is created.

The illustration further shows, by the arrow 31, the transport direction of the printing substrates 2, the impression cylinders 32 and the arrows without reference symbols in the cylinders, which indicate the direction of rotation of the latter.

Of course, not only is it possible for the invention to be implemented on a printing machine according to the example illustrated; it is also possible to proceed in an appropriate way on printing machines which are configured differently. Printing machines in which the color separations 3, 3', 3", 3'" are fed to an intermediate carrier, which transfers these jointly to a printing substrate 2, are conceivable. It is also possible for the carrier elements 14, 14', 14", 14'" for the color separations 3, 3', 3", 3'" to be configured as a belt or in any other way. All variations of designs of printing machines are conceivable, it being possible for the advantage according to the invention to be achieved in these as well.

The invention has been described in detail with particular reference to certain preferred embodiment thereof, but it will be understood that variations and modifications can be effected within the spirit and scope of the invention.

LIST OF REFERENCE SYMBOLS

| | |
|---|---|
| 1 | Print machine |
| 2 | Printing substrates |
| 3, 3', 3", 3"' | Color separation |
| 4, 4', 4", 4"' | Color separation prints |
| 5 | Leading edge of the print substrate |
| 6 | Image starts |
| 7, 7', 7",7"' | Defined areas of the color separations |
| 8, 8', 8", 8"' | Positions of the production of the color separations referred to the points of transfer to the printing substrate |
| 9, 9', 9", 9"' | Points of transfer of the color separations to the printing substrate |
| 10, 10', 10", 10"' | Color printing units |
| 11, 11', 11", 11"' | Paths - also detectable as angular positions of the drive roller - of the printing substrate from the detection of entry into the printing machine or of the substrate carrier up to the transfer points |
| 12 | Computer for calculating the relative positions of the color separations |
| 13, 13', 13", 13"' | Equipment for producing the color separations |
| 14, 14', 14", 14"' | Carrier element for the color separations |
| 15 | Sensor (arranged upstream of the printing machine) |
| 16 | Signal from the sensor 15 |
| 17 | Signal from the sensor 23 |
| 18, 18', 18", 18"' | Devices for calculating the release of the beginning of the production of the color separations |
| 19, 19', 19", 19"' | Start signals for the production of the color separations |
| 20, 20', 20", 20"' | Data for the relative position of the carrier elements for the color separations |
| 21 | Data for the relative position of the substrate carrier |
| 22 | Sensor for detecting travel times (e.g. of register marks) |
| 22' | Sensor for detecting position relationships (e.g. of register marks) |
| 23 | Sensor (arranged in the printing machine) for detecting the entry of a printing substrate into the printing machine |

-continued

| | |
|---|---|
| 24, 24', 24", 24"' | Sensor for detecting positions of carrier elements for the color separations, for example of image cylinders |
| 25, 25', 25", 25"' | Sensors for detecting positions of imge transfer elements, for example of transfer cylinders. |
| 26, 26', 26", 26"' | Image transfer cylinders |
| 27, 27', 27", 27"' | Control data for the production of the color separations |
| 28 | Substrate carrier |
| 29 | Belt for feeding printing substrates to the printing machine |
| 30 | Sensor for detecting the positions of the substrate carrier |
| 31 | Arrow: Transport direction of the printing substrates |
| 32 | Impression cylinder |
| 33 | Drive roller of the substrate carrier |

What is claimed is:

1. A method of setting registration, with detection of the entry of a printing substrate (2) into a printing machine (1) and calculation of the beginning of digital production of color separations (3, 3', 3", 3'") to achieve an in-register position of the color separation prints (4, 4', 4", 4'") on a printing substrate (2), wherein the printing substrate (2) is detected before it enters the printing machine (1) and, following this detection, the relative positions of the color separations (3, 3', 3", 3'") are calculated, and wherein precise detection of the leading edge (5) of the printing substrate (2) is performed as it enters the printing machine (1) and made the basis for determining the starts of the production of the color separations (3, 3', 3", 3'"), their relative position having been precalculated.

2. The method as claimed in claim 1, wherein the calculation of the relative positions of the color separations (3, 3', 3", 3'") comprises both the image starts (6) and the position of defined areas (7, 7', 7", . . . , 7$^n$) into which the color separations (3, 3', 3", 3'") are subdivided.

3. The method as claimed in claim 2, wherein the areas (7, 7', 7", . . . , 7$^n$) are lines of image points in the color separations (3, 3', 3", 3'").

4. The method as claimed in claim 2, wherein the areas (7, 7', 7", . . . , 7$^n$) are in each case a defined number of lines of image points.

5. The method as claimed according to claim 2, wherein for the production of the electrostatic latent color separations (3, 3', 3", 3'") in order to achieve coincidence of register are calculated and made the basis for open-loop or closed-loop control.

6. The method as claimed according to claim 2, wherein the positions (8, 8', 8", 8'") of the production of the color separations (3, 3', 3", 3'") are coordinated in relation to their points of transfer (9, 9', 9", 9'") to the printing substrate (2) in order to achieve coincidence of registration, and with the paths (11, 11', 11", 11'") of the printing substrate (2) up to the points of transfer (9, 9', 9", 9'").

7. Apparatus for setting registration on a printing machine (1) having a number of color printing units (10, 10', 10", 10'") in order to produce a number of color separation prints (4, 4', 4", 4'"), said apparatus comprising: a sensor (23) detecting the entry of a printing substrate (2) into the printing machine (1), and a computer (12) calculating and initiating the beginning of production of color separations (3, 3', 3", 3'") by equipment (13, 13', 13", 13'") for the digital production of said color separations (3, 3', 3", 3'") on a carrier element (14, 14', 14", 14'"), wherein a sensor (15) arranged upstream of the printing machine (1) detects the printing substrate (2) before it enters the printing machine (1) and gives a signal (16) to the computer (12), whereupon the latter calculates the relative positions of the color separations (3, 3', 3", 3'"), and wherein said sensor (23) arranged in the printing machine (1) gives a signal (17) to devices (18, 18', 18", 18'") for determining the release of start signals (19, 19', 19", 19'") for the production of the color separations (3, 3', 3", 3'"), whose relative positions have been precalculated.

8. The apparatus as claimed in claim 7, wherein the computer (12) is loaded with data (20, 20', 20", 20'", 21) for the relative position of the carrier elements (14, 14', 14", 14'") and a substrate carrier (28), and performs a calculation which, with respect to the relative positions of the color separations (3, 3', 3", 3'"), comprises the image starts (6) and the position of the defined areas (7, 7', 7", . . . , 7$^n$) into which the color separations are subdivided, and controls the equipment (13, 13', 13", 13'") for the production of the color separations on this basis.

9. The apparatus as claimed in claim 8, wherein it has at least one sensor (22) for detecting a defined component of a color separation (3, 3', 3", 3'"), and the computer (12) is such that it coordinates the relative positions, detected in this way, of the areas (7, 7'7", . . . , 7$^n$) of the individual color separations with one another in order to achieve coincidence of register and coordinates the relative position of the substrate carrier (28) in order to position the print on said substrate carrier.

10. The apparatus as claimed according to claim 8, wherein it has sensors (22', 24, 24', 24", 24'", 25, 25', 25", 25'", 30) for detecting angular positions (8, 8', 8", 8'") of the elements (14, 14', 14", 14'", 26, 26', 26", 26'") that transfer color separations and the angular positions of the drive roller (33) of the substrate carrier (28), and the computer (12) is such that it coordinates the angular positions (8, 8', 8", 8'") of the elements (14, 14', 14", 14'", 26, 26', 26", 26'") that transfer color separations with one another in order to achieve coincidence of register, and coordinates the angular positions (11., 11', 11", 11'") of the drive roller (33) of the substrate carrier (28) with the aforementioned angular positions (8, 8', 8", 8'").

* * * * *